US006546955B1

(12) United States Patent
Burke

(10) Patent No.: US 6,546,955 B1
(45) Date of Patent: Apr. 15, 2003

(54) VAPOR CANISTER AND FUEL TANK ASSEMBLY

(75) Inventor: David Howard Burke, Flint, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/702,475

(22) Filed: Oct. 31, 2000

(51) Int. Cl.[7] ..... F02M 33/02

(52) U.S. Cl. ..... 137/557; 137/351; 123/516; 123/520

(58) Field of Search ..... 123/516, 518, 123/520; 137/557, 351

(56) References Cited

U.S. PATENT DOCUMENTS 4,468,838 A * 9/1984 Sjostrom et al. ..... 452/160
4,886,096 A * 12/1989 Reddy ..... 141/45
5,239,858 A * 8/1993 Rogers et al. ..... 73/40.7
5,245,973 A * 9/1993 Otsuka et al. ..... 123/518
5,669,361 A * 9/1997 Weissinger et al. ..... 123/520
5,671,718 A * 9/1997 Curran et al. ..... 123/520
5,715,799 A * 2/1998 Blomquist et al. ..... 123/520
6,050,245 A * 4/2000 Cook et al. ..... 123/520
6,067,967 A * 5/2000 Kidokoro et al. ..... 123/516

* cited by examiner

*Primary Examiner*—A. Michael Chambers
(74) *Attorney, Agent, or Firm*—Vincent A. Cichosz

(57) ABSTRACT

A vapor canister and fuel tank assembly for a vehicle includes a fuel tank having an interior chamber and a vapor canister fluidly communicating with the interior chamber of the fuel tank to adsorb vapor fuel. The vapor canister and fuel tank assembly also includes a pressure sensor located on a clean side of the vapor canister to monitor pressure in the assembly.

11 Claims, 1 Drawing Sheet

VAPOR CANISTER AND FUEL TANK ASSEMBLY

TECHNICAL FIELD

The present invention relates generally to fuel tanks for vehicles and, more particularly, to a vapor canister and fuel tank assembly for a vehicle.

BACKGROUND OF THE INVENTION

It is known to provide a fuel tank in a vehicle to hold fuel to be used by an engine of the vehicle. It is also known to provide a vapor recovery and storage system for the fuel tank of the vehicle. Typically, the vapor recovery and storage system includes a vapor canister remotely mounted such as in an engine compartment of the vehicle and operatively connected by separate external valves and lines to the fuel tank. It is also known to test the integrity of the vapor recovery and storage system by either pressurizing or applying vacuum to the fuel tank and vapor canister. Many of these systems also use a pressure transducer or sensor connected to the fuel tank to monitor the pressure/vacuum decay in the fuel tank. For measuring fuel vapor leakage, engine vacuum is used to draw a vacuum on the vapor recovery and storage system and valves are closed to seal the vacuum in the vapor recovery and storage system while measuring pressure with the pressure transducer in the fuel tank. However, the pressure transducer presents an additional source of fuel vapor leakage and permeation from the fuel tank.

It is desirable to remove the pressure transducer from the fuel tank. It is also desirable to locate the pressure transducer in another location of the vapor recovery and storage system in a vehicle to monitor the pressure.

SUMMARY OF THE INVENTION

It is, therefore, one object of the present invention to provide a vapor canister and fuel tank assembly for a vehicle.

It is another object of the present invention to provide a vapor canister and fuel tank assembly for a vehicle that locates the pressure transducer or sensor in a location other than the fuel tank.

To achieve the foregoing objects, the present invention is a vapor canister and fuel tank assembly for a vehicle including a fuel tank having an interior chamber and a vapor canister fluidly communicating with the interior chamber of the fuel tank to adsorb vapor fuel. The vapor canister and fuel tank assembly also includes a pressure sensor located on a clean side of the vapor canister to monitor pressure in the assembly.

One advantage of the present invention is that a vapor canister and fuel tank assembly is provided for a vehicle. Another advantage of the present invention is that the vapor canister and fuel tank assembly removes the pressure transducer or sensor from the fuel tank to eliminate a source of hydrocarbon permeation and potential leaks. Yet another advantage of the present invention is that the vapor canister and fuel tank assembly locates the pressure transducer at either the clean-air side of the vapor canister or in the fresh air vent line coming out of the clean side of the vapor canister so that there are little or no hydrocarbons left in the air that contacts the sensor to leak or permeate. Still another advantage of the present invention is that the vapor canister and fuel tank assembly provides a vapor canister exposed only to vapor fuel and isolated from liquid fuel, water, salt, dirt, etc., minimizing external connectors and prevents the pressure sensor from being contaminated.

Other objects, features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
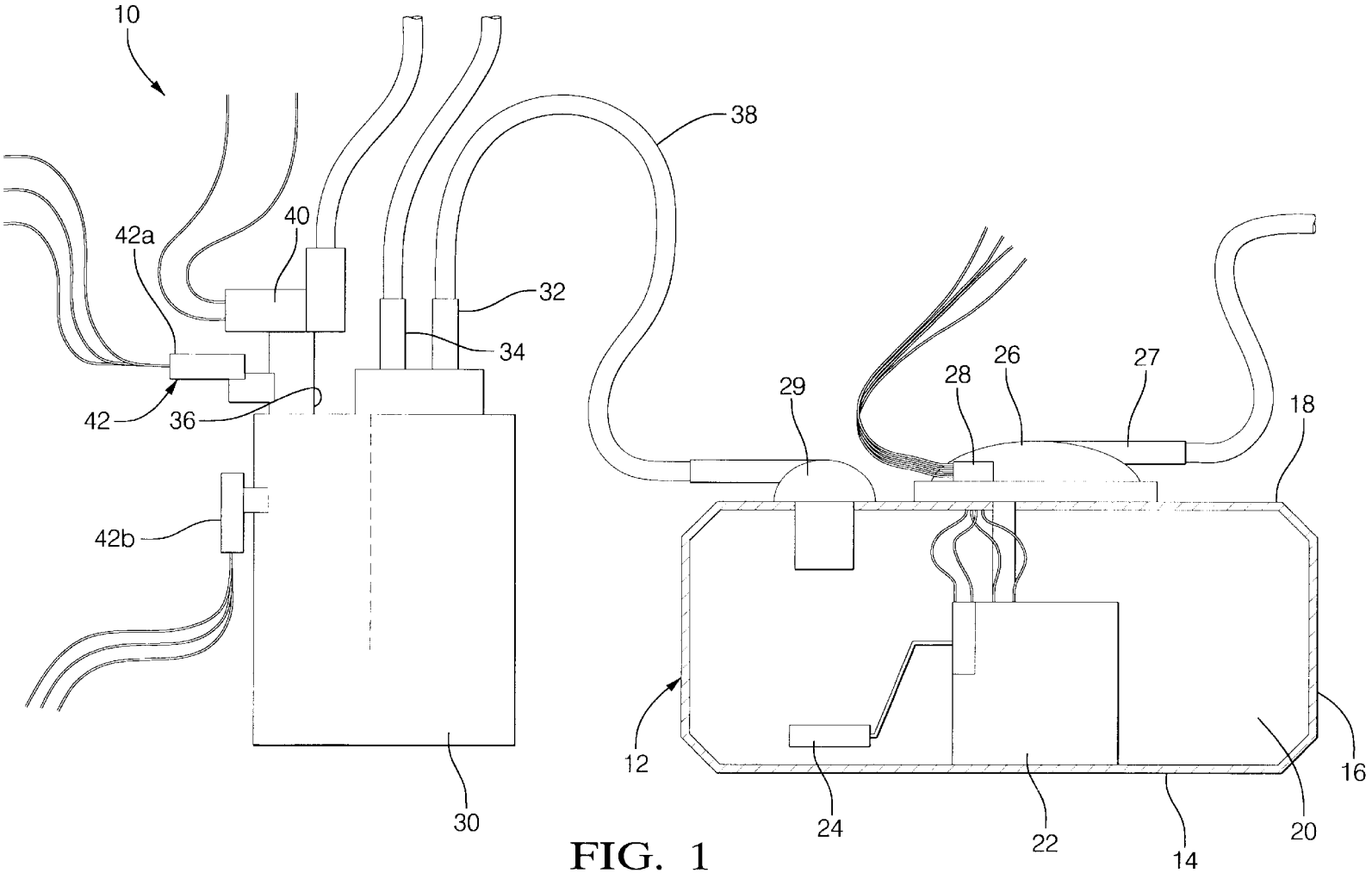
FIG. 1 is a diagrammatic view of a vapor canister and fuel tank assembly, according to the present invention.

Referring to the drawings and in particular FIG. 1, one embodiment of a vapor canister and fuel tank assembly 10, according to the present invention, is shown for a vehicle (not shown). The vapor canister and fuel tank assembly 10 includes a fuel tank, generally indicated at 12, to hold liquid fuel. In this embodiment, the fuel tank 12 includes a bottom or base wall 14 and a side wall 16 around a periphery of the base wall 14 and extending generally perpendicular thereto. The fuel tank 12 also includes a top wall 18 extending generally perpendicular to the side wall 16 to form an interior chamber 20. The fuel tank 12 is made of a rigid material, preferably a plastic material. It should be appreciated that the fuel tank 12 could be made of a metal material such as steel.

The vapor canister and fuel tank assembly 10 includes a fuel pump module 22 disposed in the interior chamber 20 of the fuel tank 12. The fuel pump module 22 contains a pump (not shown) and a mechanism 24 for measuring fuel level in the interior chamber 20 of the fuel tank 12. The fuel pump module 22 has a cover 26 that has at least one tube 27 for liquid fuel and an opening 28 for an electrical pass-through. The vapor canister and fuel tank assembly 10 also includes at least one vent or rollover anti-spill valve 29 to allow vapor and air from the fuel tank 12 to communicate with a vapor canister 30 to be described. It should be appreciated that the fuel pump module 22 is conventional and known in the art.

The vapor canister and fuel tank assembly 10 also includes a vapor canister 30 holding a canister bed (not shown) to adsorb hydrocarbon vapor while allowing air to pass to and from the fuel tank 12. The vapor canister 30 has a first tube 32 for communicating with the fuel tank 12, a second tube 34 being purged by an engine (not shown) and a third tube 36 communicating with the outside environment. It should be appreciated that the vapor canister 30 is conventional and known in the art.

The vapor canister and fuel tank assembly 10 includes a hose or conduit 38 interconnecting the first tube 32 and the valve 29. The vapor canister and fuel tank assembly 10 further includes a vent valve 40 to seal the system for testing system leakage. The vapor canister and fuel tank assembly 10 includes a pressure sensor, generally indicated at 42, for sensing the pressure of the fuel to determine how well the system maintains vacuum once the vent valve 40 has been closed. The pressure sensor 42 may be a pressure sensor **42*a* located between the vapor canister 30 and the vent valve 40 and extending into the third tube 36 or a pressure sensor 42*b* located on a side of the vapor canister 30 and extending into the vapor canister 30. It should be appreciated that the pressure sensor 42 is located where there is relatively clean air on both sides. It should also be appreciated that the pressure sensor 42** is electrically connected to an electronic controller (not shown).

In operation, engine vacuum is used to draw a vacuum on the vapor canister and fuel tank assembly 10. The valves are closed to seal the vacuum in the vapor canister and fuel tank assembly 10. The vapor canister holds the fuel vapor, allowing fairly clean air to pass into and out of the fuel tank. Once the vapor canister and fuel tank assembly 10 is sealed, the pressures on each side of a restriction will equalize. Therefore, the transducer will be able to measure vacuum decay due to a system leak regardless of where in the sealed part of the system it is placed. It should be appreciated that the pumping of liquid fuel and purging of vapor fuel is conventional and known in the art.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A vapor canister and fuel tank assembly for a vehicle comprising:

a fuel tank having an interior chamber;

a vapor canister fluidly communicating with said interior chamber of said fuel tank to adsorb vapor fuel, said vapor canister having a canister bed to adsorb the vapor fuel while allowing air to pass to and from said fuel tank; and a pressure sensor located on a clean side of said vapor canister and extending into said vapor canister to monitor pressure in said assembly.

2. A vapor canister and fuel tank assembly as set forth in claim 1 wherein said vapor canister includes a first tube fluidly communicating with atmosphere and a second tube fluidly communicating with said interior chamber.

3. A vapor canister and fuel tank assembly as set forth in claim 2 including a vent valve on said first tube to open and close said first tube.

4. A vapor canister and fuel tank assembly as set forth in claim 2 including a roll-over valve disposed on said fuel tank and extending into said interior chamber.

5. A vapor canister and fuel tank assembly as set forth in claim 4 including a hose interconnecting said second tube and said rollover valve.

6. A vapor canister and fuel tank assembly for a vehicle comprising:

a fuel tank having an interior chamber;

a vapor canister having a first tube fluidly communicating with atmosphere and a second tube fluidly communicating with said interior chamber of said fuel tank to adsorb vapor fuel, said vapor canister having a canister bed to adsorb the vapor fuel while allowing air to pass to and from said fuel tank; and a pressure sensor located on and extending into said first tube to monitor pressure in said assembly.

7. A vapor canister and fuel tank assembly as set forth in claim 6 including a vent valve on said first tube to open and close said first tube.

8. A vapor canister and fuel tank assembly as set forth in claim 7 wherein said pressure sensor is located on said first tube between said vent valve and said vapor canister.

9. A vapor canister and fuel tank assembly as set forth in claim 6 including a roll-over valve disposed on said fuel tank and extending into said interior chamber.

10. A vapor canister and fuel tank assembly as set forth in claim 9 including a hose interconnecting said second tube and said rollover valve.

11. A vapor canister and fuel tank assembly for a vehicle comprising:

a fuel tank having an interior chamber;

a vapor canister having a first tube fluidly communicating with atmosphere and a second tube fluidly communicating with said interior chamber of said fuel tank to adsorb vapor fuel, said vapor canister having a canister bed to adsorb the vapor fuel while allowing air to pass to and from said fuel tank;

a rollover valve disposed on said fuel tank and extending into said interior chamber;

a hose interconnecting said second tube and said rollover valve;

a vent valve on said first tube to open and close said first tube; and a pressure sensor located on and extending into said first tube between said vent valve and said vapor canister to monitor pressure in said assembly.

* * * * *